US007927542B2

(12) United States Patent
Di Bono et al.

(10) Patent No.: US 7,927,542 B2
(45) Date of Patent: Apr. 19, 2011

(54) CLOTHES CONDITIONING HANGER AND METHOD OF USING SAME

(75) Inventors: Giuseppe Di Bono, Mira (IT); Giorgio Franzolin, Mira (IT)

(73) Assignee: Reckitt Benckiser NV, Hoofddrop (NL)

( * ) Notice: Subject to any disclaimer, the term of this patent is extended or adjusted under 35 U.S.C. 154(b) by 315 days.

(21) Appl. No.: 12/279,083

(22) PCT Filed: Feb. 19, 2007

(86) PCT No.: PCT/GB2007/000552

§ 371 (c)(1),
(2), (4) Date: Oct. 10, 2008

(87) PCT Pub. No.: WO2007/093811

PCT Pub. Date: Sep. 23, 2007

(65) Prior Publication Data

US 2009/0129972 A1 May 21, 2009

(30) Foreign Application Priority Data

Feb. 18, 2006 (GB) ..... 0603288.2

(51) Int. Cl.
*A61L 9/00* (2006.01)

(52) U.S. Cl. ..... 422/5

(58) Field of Classification Search ..... 422/5
See application file for complete search history.

(56) References Cited

U.S. PATENT DOCUMENTS 2,755,013 A * 7/1956 Beede ..... 206/287
3,790,044 A 2/1974 Verdile
5,167,564 A 12/1992 Lord
6,149,038 A 11/2000 Tsai
2004/0265196 A1* 12/2004 Varanasi et al. ..... 422/305

FOREIGN PATENT DOCUMENTS

CH 219384 A 2/1942
FR 826461 A 3/1938
FR 859377 A 12/1940
FR 1261277 A 5/1961
JP 08228851 A1 9/1996
WO 2004103127 A 12/2004

OTHER PUBLICATIONS

English Language Abstract for JP8228851 taken from esp@cenet.com, 1996.
English Language Abstract and Summary for FR1261277 taken from French Republic, Ministry of Industry, Industrial Property Division, 1961.
English Language Abstract and Summary for FR826461 taken from French Republic, Ministry of Industry, Industrial Property Division, 1938.
English Language Abstract and Summary for CH219384 taken from Swiss Confederation, Federal Intellectual Property Office, 1942.
English Language Abstract and Summary for FR859377 taken from French Republic, Ministry of Industrial Production and Labour, Industrial Property Division, 1940.

* cited by examiner

*Primary Examiner* — Walter D Griffin
*Assistant Examiner* — Timothy Cleveland
(74) *Attorney, Agent, or Firm* — Norris McLaughlin & Marcus, PA

(57) ABSTRACT

An apparatus comprises a clothes-conditioning hanger able to condition (e.g. fragrance) clothing on the hanger. The hanger has a socket (9) beneath its apex (4), which can retain a source of conditioning agent. The hanger arms (3) contain passageways and apertures (6) whereby conditioning agent may be delivered to the clothing on the hanger.

19 Claims, 4 Drawing Sheets

CLOTHES CONDITIONING HANGER AND METHOD OF USING SAME

This application is a 371 application of PCT/GB2007/000552 filed Feb. 19, 2007, which claims priority to British Patent Application No. 0603288.2 filed Feb. 18, 2006.

This invention relates to an apparatus and method for freshening fabrics, in particular items of clothing.

Clothes routinely become exposed to a wide range of smells, for example from tobacco smoke, food, pets and body odour.

Sometimes exposure to such smells may only be for a short period, for example during an evening spent in a bar or other smoky environment, and a wearer may not wish to wash their clothes after wearing them for only a few hours.

Repeated washing may lead to damage of clothes; colours may fade and articles made from delicate fabric may be ruined if repeatedly washed in an automatic washing machine. Many fabrics must be dry-cleaned which is inconvenient and costly.

Often clothes are washed not because of any visible soils, but because they do not smell pleasant.

It is an object of embodiments of the present invention to provide a way of conditioning fabrics (for example freshening and/or fragrancing them) without using traditional cleaning methods.

According to a first aspect of the present invention there is provided a conditioning hanger comprising:

- two arms connected to a central region;
- hanging means carried by the central region or apex, for suspending the conditioning hanger;
- receiving means located at said central region or apex, being adapted to receive a source of conditioning agent; and
- at least one passageway connecting said receiving means to at least one dispensing aperture of the conditioning hanger.

The conditioning hanger suitably has the general shape and form of a traditional coat hanger. The two arms are preferably connected at a central region or apex to form a shape like a boomerang. The angle between the two arms, at the apex, is preferably obtuse; preferably it is in the range 100° to 160°.

The arms may be made of any suitable material, for example wood, metal or a plastics material, or a combination, for example plastics-coated wire. Preferably they are made of a plastics material.

Preferably the arms are of the same size and shape, being a mirror image of each other about a vertical plane passing through the central region.

Preferably the passageway extends along an arm of the hanger. It may, for example, be a tube associated with the arm; for example running along and attached to the arm. Preferably, however, the arm itself constitutes or defines the passageway. In one embodiment the arm is tubular. In another embodiment the arm is in the shape of an arch when viewed in transverse cross-section. This arch may be open at its lower end (e.g. housing a separate tube) or closed to form a passageway or conduit.

Preferably each arm has such a passageway.

Preferably there is at least one passageway connecting said receiving means to a dispensing aperture associated with one arm, and at least one passageway connecting said receiving means to a dispensing aperture associated with the other arm.

The arms may be of uniform cross-section or they may taper. When they taper, they are preferably of larger cross-section in the region where they join at the apex and of smaller cross-section at or adjacent to their distal ends.

In a preferred embodiment, a dispensing aperture is located at or adjacent to the distal end of each arm. Preferably, a cavity within each arm defines a passageway leading from the receiving means at the apex to the dispensing aperture at the distal end of the respective arm.

The passageways may comprise a plurality of apertures. These may all be located at or adjacent to the distal ends of the arms. Preferably, however they are spaced along the arms. In a preferred embodiment in which the arms are arched in cross section and covered across the lower surface to form passageways, a series of apertures may be provided spaced along the covering part which forms the lower surface of each passageway.

Alternatively or additionally there may be at least one dispensing aperture in the area of the apex, in communication with the receiving means.

A hanger as described above is suitable for mounting shirts, coats, dresses and the like.

Optionally, the hanger may further comprise a hanging bar linking the distal ends of the arms, the hanging bar being substantially horizontal in use. Such hangers are well-known and the bar is usually used for hanging trousers.

Optionally, the hanger of the invention may also comprise clips located at or adjacent to the distal ends of the arms, and/or on the hanging bar, when present. The clips are suitably spring clips of the type found on traditional hangers and may be used to hold skirts and the like.

The upper surface of the arms, on which an item of clothing sits, and/or the upper surface of a hanging bar, may have an anti-slip surface, such as an elastomer insert, or may be textured, to prevent the item from sliding off the hanger.

In some embodiments the upper surfaces of the arms adjacent to their distal ends may be provided with respective retaining formations to receive straps of clothing or loops carried by clothing, to hold the clothing in place. The retaining formations may be formed by way of sprigs, nocks or slits in the upper surfaces of the arms, adjacent to the distal ends of the arms. Alternatively they may be formed by pegs projecting upwardly from the upper surfaces of the arms. Preferably the pegs are directed towards the central region, with a gap between each peg and the adjacent upper region of the respective arm. Such retaining formations may be found on conventional hangers and by means of such formations items of clothing may be held more securely on the conditioning hanger.

The receiving means may be of any form able to receive a conditioning agent. It may simply comprise an aperture, or a hook.

Preferably the receiving means allows a conditioning agent to be retained at (preferably beneath) the apex of the hanger.

Preferably the receiving means comprises a socket of a shape suitable to accept a source of conditioning agent. Alternatively it may comprise a protrusion designed to engage with a socket located on the source of conditioning agent.

In a preferred embodiment in which the receiving means is a socket, the socket may comprise a threaded aperture designed to engage with a screw on the source of conditioning agent. Alternatively the two portions may be secured together by a bayonet fitting, or by an in-and-out linear sliding action. The two parts may clip together, or otherwise lock together. Preferably the movement of the source of conditioning agent itself causes the source of conditioning agent to be locked into the socket. Preferably a release means must be operated, to allow the parts to be separated.

The engagement of the hanger and the source of conditioning agent is preferably facile and reversible.

In an especially preferred embodiment, the receiving means comprises a socket which depends downwardly from the apex. The socket is approximately oval in cross section. In the region of the lower edge of the socket, there are preferably provided at least two slits or tabs which engage with corresponding slits or tabs located on the source of conditioning agent.

The source and nature of the conditioning agent is described in more detail below.

The hanging means may comprise any means suitable for mounting the hanger in a suspended position. For example, the hanging means may comprise a loop of material such as a wire, elastic or fabric by means of which the hanger may be hung from a hook, or from a rail.

Alternatively the hanging means may comprise a stem with a shaped end part designed to engage a receiving member located for example in a wardrobe. Such hangers which may only be mounted on a member in a wardrobe rail are commonly used in hotels, lockers in changing rooms and the like.

Preferably, however, the hanging means comprises a simple hook, preferably of wire, such as is commonly found on traditional coat hangers.

According to a second aspect of the present invention, there is provided an apparatus for conditioning fabrics (for example freshening clothes) comprising a conditioning hanger of the first aspect and a source of conditioning agent.

The conditioning agent suitably comprises a fragrance and/or a deodorising agent (which may be non-fragrancing) and/or a sanitiser. In principle it could be an agent offering other fabric care benefit, for example an ironing aid, wrinkle remover, handle modifier, allergen deactivant or pesticidal agent.

In one simple form, the source of conditioning agent may comprise a solid block of material which may sublime to release a vapour having fabric conditioning properties. However, the source of conditioning agent preferably comprises a reservoir of liquid material.

The source of conditioning agent preferably comprises a means for releasing the agent so that it may be delivered as a vapour along the passageway(s) to the dispensing aperture(s).

This means for releasing may simply comprise an opening so that the conditioning agent may evaporate into the region of the receiving means and then diffuse to the aperture(s).

The conditioning agent suitably comprises a solid, which may sublime, or a liquid, which may evaporate. Preferably it is an oil which is released as a vapour over a period of time, when the apparatus is in use.

The conditioning agent may comprise a single chemical substance or may be a mixture. Preferably the conditioning agent comprises a combination of a fragrance and a non-fragrancing deodorising agent.

Examples of suitable fragrances include floral fragrances (e.g. lily, rose), woody fragrances (e.g. cinnamon, nutmeg), mint fragrances (peppermint, spearmint) and fruit fragrances (e.g. lemon, orange, lime, strawberry).

Examples of suitable non-fragrancing deodorising agents include cyclodextrins.

Vapour may be passively released from the source by evaporation. Alternatively, the release of a vapour from the source of conditioning agent may be enhanced. Enhancement may be by supply of heat and/or by use of a fan.

A supply of heat may be continuous or periodic, only occurring at certain intervals.

A fan may operate continuously or periodically for limited intervals.

A heater may operate continuously or periodically for limited intervals.

In preferred embodiments vapour is not merely released from the source of conditioning agent by evaporation directly from the source. Preferably the conditioning agent is contained in the reservoir in liquid form and the source of conditioning agent preferably further comprises a wick in communication with the conditioning agent.

Preferably the apparatus has an emanator carried by the wick and located outside the reservoir, the emanator preferably being larger in cross-section than the wick. Preferably the emanator is carried at the top of the wick, that is, at the distal end of the wick. Preferably the proximal end of the wick is immersed in the conditioning agent until the conditioning agent is exhausted.

Preferably the emanator is a body which has a surface over which air flows. For example it may have a generally planar surface, transverse to the wick. Preferably such a surface is substantially perpendicular to the wick. Preferably it is of area in the range 400-1600 $mm^2$, more preferably 600-1200 $mm^2$.

Preferably the emanator and the wick are generally T-shaped in cross-section taken along the axis of the wick.

Preferably the emanator is circular in plan view.

Preferably the area of the emanator, in plan view, is at least two times the cross-sectional area of the wick, more preferably at least four times, and most preferably at least six times.

Preferably the emanator is located within the centre region of the hanger so that, in use, air is able to flow over the top of it. The reservoir preferably has an upper wall through an aperture in which the wick extends; and the emanator may rest against that upper wall.

Preferably the wick, as well as the emanator when present, may be an ordinary capillary body, for example formed by hot pressing, extrusion or sintering of a fibrous material, for example polyolefin fibres.

Preferably the emanator does not have any non-capillary through-bores.

Preferably the upper wall of the reservoir has an aperture which is slightly oversized, for the wick. This is to permit venting and also to allow any chemical agent on top of the reservoir to drain back into it In some embodiments, the source of conditioning agent further comprises:

an electrically operable fan to impel air over the emanator; and battery means to operate the fan.

Preferably the source includes a base on which are mounted the fan, and a motor therefor.

Preferably the fan stands proud of the motor, to aid free running of the fan.

Preferably the reservoir is formed with a deflection surface generally facing the fan. The deflection surface is present to deflect impelled air out of a smooth upwards pathway towards the outlet of the apparatus, and/or to introduce or increase turbulence. Preferably the deflection surface is an undercut or overhanging wall portion formed in the side wall of the reservoir.

Preferably the fan is located generally on one side of the source and the outlet is located generally on the other side of the source, the former preferably being at a low position and the latter preferably being at a high position; and with the emanator being located between them, such that the impelled air must pass the emanator to reach the outlet. The deflection surface, when provided, is preferably slanted to urge impelled air away from the emanator. In doing so it ensures that air follows a tortuous pathway between the fan and the outlet and/or that the airflow has a high degree of turbulence.

Preferably the operation of the fan is controllable. In one embodiment it could be controlled by fan speed. For example a high speed setting could lead to fast evaporation to allow speedy fragrancing/deodorising for a user in a hurry. A lower speed setting would allow gentle fragrancing/deodorising over a longer period as an item is stored. In alternative embodiments, operation of the fan is controlled by controlling the periods for which the fan operates. Thus, the apparatus may include an electronic timing circuit. In one embodiment its mode of operation may be as follows:

passive operation—fan off. Some natural evaporation is likely to take place from the emanator.

medium-level operation—short bursts of fan operation, separated by non-operation, and controlled by the timing circuit.

boost operation—longer periods of fan operation and/or shorter periods in between than in regular operation, and controlled by the timing circuit.

Many operational regimes could be defined by the timing circuit.

The source of conditioning agent as a whole may be removed from the conditioning hanger and replaced when the conditioning agent has expired.

Alternatively, a new reservoir comprising agent may be supplied separately and fitted to the source when the supply from the previous reservoir is exhausted.

When present, batteries to operate the fan may also be exchanged separately, in some embodiments.

In certain embodiments, a refill pack may be supplied comprising a reservoir and batteries. In such embodiments, the source of conditioning agent is preferably designed so that the batteries and conditioning agent are exhausted after a similar period.

According to a third aspect of the invention there is provided a method of conditioning a fabric item (for example freshening an item of clothing,) using an apparatus of the second aspect, the method comprising the steps of:

(a) attaching a source of conditioning agent to the receiving means located at the apex of a conditioning hanger of the first aspect (b) mounting the item on the hanger;

(c) leaving the item on the hanger for a period of time; and (d) removing the item from the hanger.

Steps (a) and (b) may be performed in either order.

In embodiments in which the source of conditioning agent comprises a fan, the method further comprises the step, after step (a), and preferably after step (a) and step (b), of turning on the fan; and the step of turning off the fan, after step (c) (e.g. manually or under the control of a timer).

The time interval in step (c) is at least 30 minutes, preferably at least 45 minutes.

The method of conditioning fabrics of the third aspect of the present invention may be used in several situations.

In some embodiments, the method may simply comprise storing an item for long periods on an apparatus of the second aspect. In such embodiments the fan, when present, will not be turned on. Instead, passive evaporation of the conditioning agent will be allowed to occur over time. Such a method would be suitable, for example, for the storage of a favourite item of clothing to be worn on special occasions; when the conditioning agent comprises a fragrance or deodorizer, the item of clothing would always smell pleasant.

Alternatively, the method may be used to quickly refresh items which are required soon, or to remove malodour before fabrics are stored away. In such methods, the rate of delivery of the conditioning agent is preferably increased, for example by means of a fan or of a heater.

In certain embodiments, the item once mounted on the hanger is covered by a cover sheet. Use of a cover sheet means that the vapour from the conditioning agent is kept in the vicinity of the fabric for longer so that the time taken to achieve the same conditioning effect is reduced According to a fourth aspect of the present invention there is provided a kit comprising the apparatus of the second aspect and a cover sheet.

This cover sheet is of a size suitable to fit over an item of clothing mounted on a hanger. It may comprise a single sheet of material which is draped over the item of clothing, as a shroud. Preferably it is in the form of a bag. The bag suitably comprises two sheets of material sealed along edges but such as to leave an opening, to permit insertion and removal of the hanger and fabric. The opening may be releasably closable e.g. by hook and eye means or by a zip. Preferably the sheets are rectangular. Typically the shorter side is of length between 30 and 70 cm and the longer side is of length between 80 and 180 cm.

Preferably the shorter sealed edge of the bag has a hole adapted to receive the hanging means so that the hanging means (e.g. a hook) may be threaded through the hole allowing the bag to hang from the hanger, with the hanger inside the bag.

In its simplest form, the bag has an opening at its lower, shorter, edge so that it is simply pulled over the fabric item and hanger.

In other embodiments, the bag may be permanently sealed along its lower edge and may comprise an opening along the front sheet; for example from top to bottom, or diagonally. This opening may or may not be sealable.

Suitable bags are available: for example they are commonly used to cover suits.

According to a fifth aspect of the present invention, there is provided a method of conditioning a fabric item, the method comprising the steps of:

(a) mounting the item on a conditioning hanger of the first aspect;

(b) attaching a source of conditioning agent to the receiving means of the hanger;

(c) covering the mounted item with a cover sheet;

(d) leaving the resulting assembly for a period of time;

(e) removing the cover sheet from the mounted item; and (f) removing the item from the hanger.

Steps (a), (b) and (c) may be undertaken in any order. Steps (e) and (f) may be reversed.

The method may further comprise the steps of enhancing the release of vapour from the source of conditioning agent (e.g. by supply of heat and/or use of a fan) before step (d) and optionally discontinuing such enhancement after step (d).

The invention will now be described by way of example with reference to the accompanying figures, in which.

Figure 1:
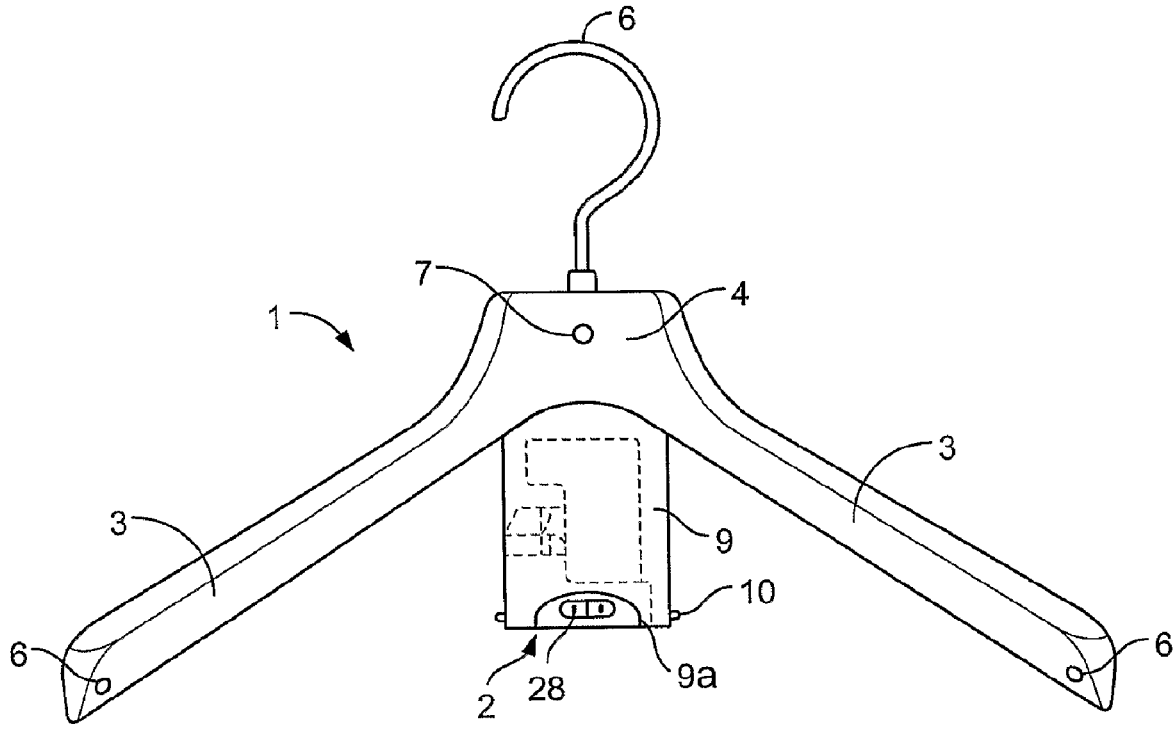
FIG. 1 shows an apparatus of the one aspect of the invention, comprising a conditioning hanger and a source of conditioning agent connected thereto such that the apparatus is ready to use.
Figure 4:
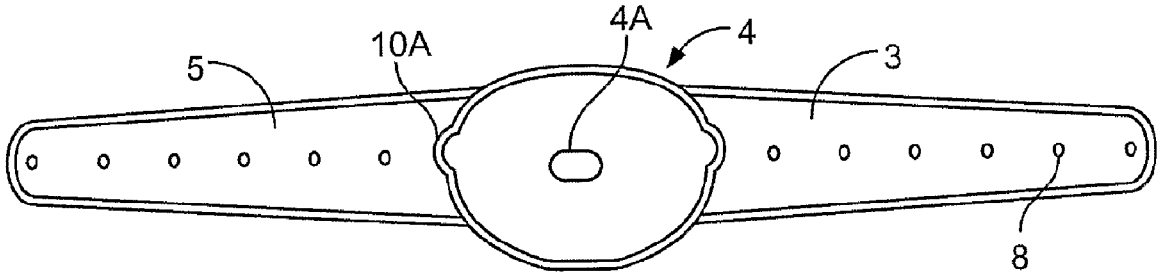
FIG. 4 shows a plan view of the underside of the hanger of FIG. 1, from direction A shown in FIG. 1

Hanger 1, shown in FIG. 1, comprises two arms 3 connected to a central region or apex 4, to the top of which is attached a wire hook 6. The apex has on its inside an opening 4A. Each arm 3 is arched in cross section but is closed by a base plate 5 (see FIG. 4) and thus forms a passageway or conduit. These passageways lead from the opening 4A in apex 4 to the distal ends of the arms where apertures 6 are located. There are four such apertures, one on the front face and one on the back face of each arm. Further apertures 7 are located on the front and back faces of apex 4. Yet further apertures 8 are provided along the base plates 5, as can be seen in FIG. 4.

In this embodiment, a source of conditioning agent is provided within a removable unit which is carried by the hanger, within a receiving means 9 under the apex 4. The receiving means 9 is in the form of a socket. The receiving means comprises a cylindrical sleeve, substantially oval in cross-section, and is suitably of perspex or other plastics material. In order to receive removable unit 2, the sleeve is downwardly open. The lower region of sleeve 9 comprises a cut out portion 9*a* to allow access to switch 28, of removable unit 2. Two slits are also provided in the lower region of the sleeve in order to accommodate tabs 10 located on the base portion of removable unit 2.

Figure 2:
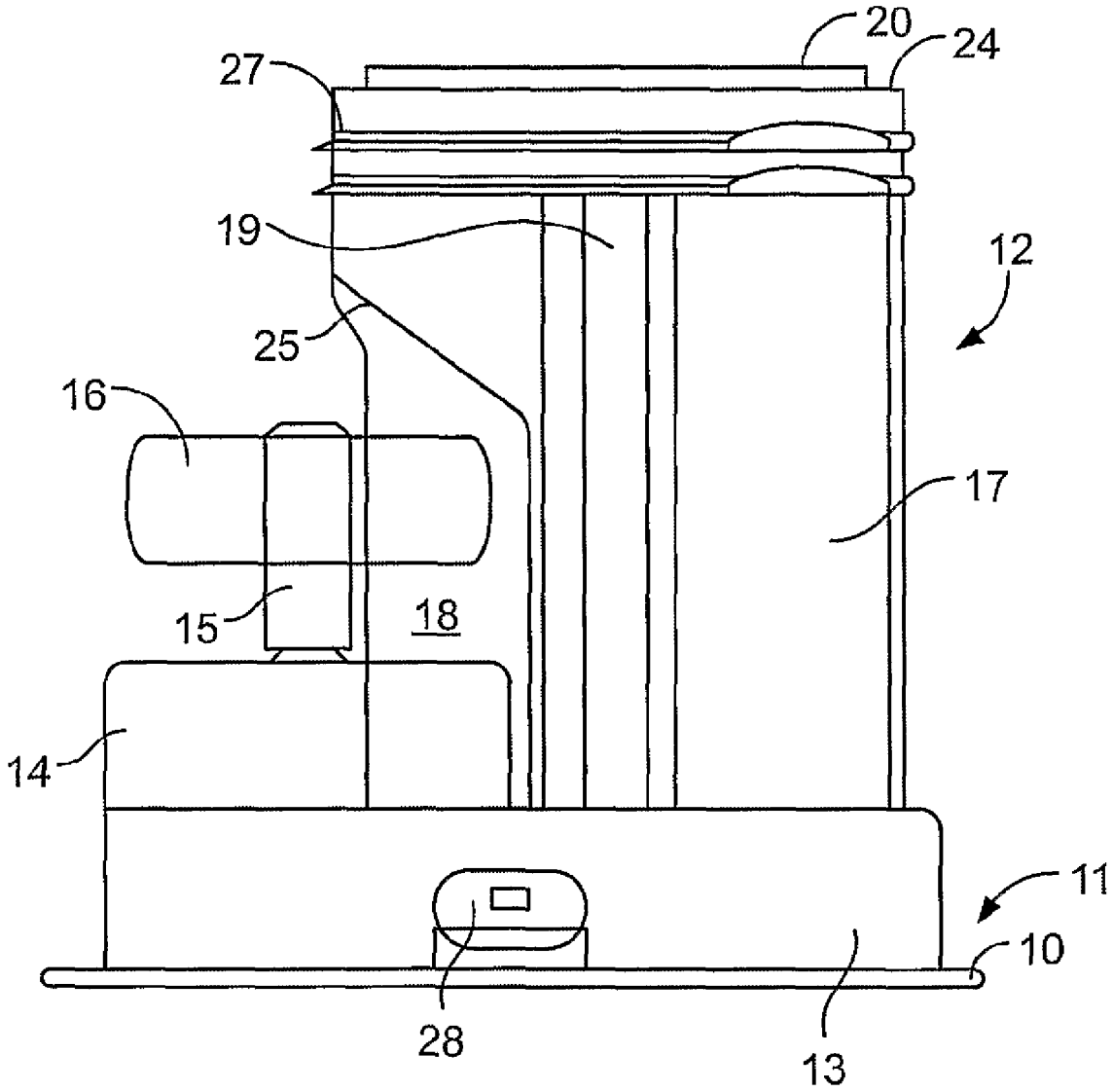
FIG. 2 shows a side elevation of the source of conditioning agent.
Figure 3:
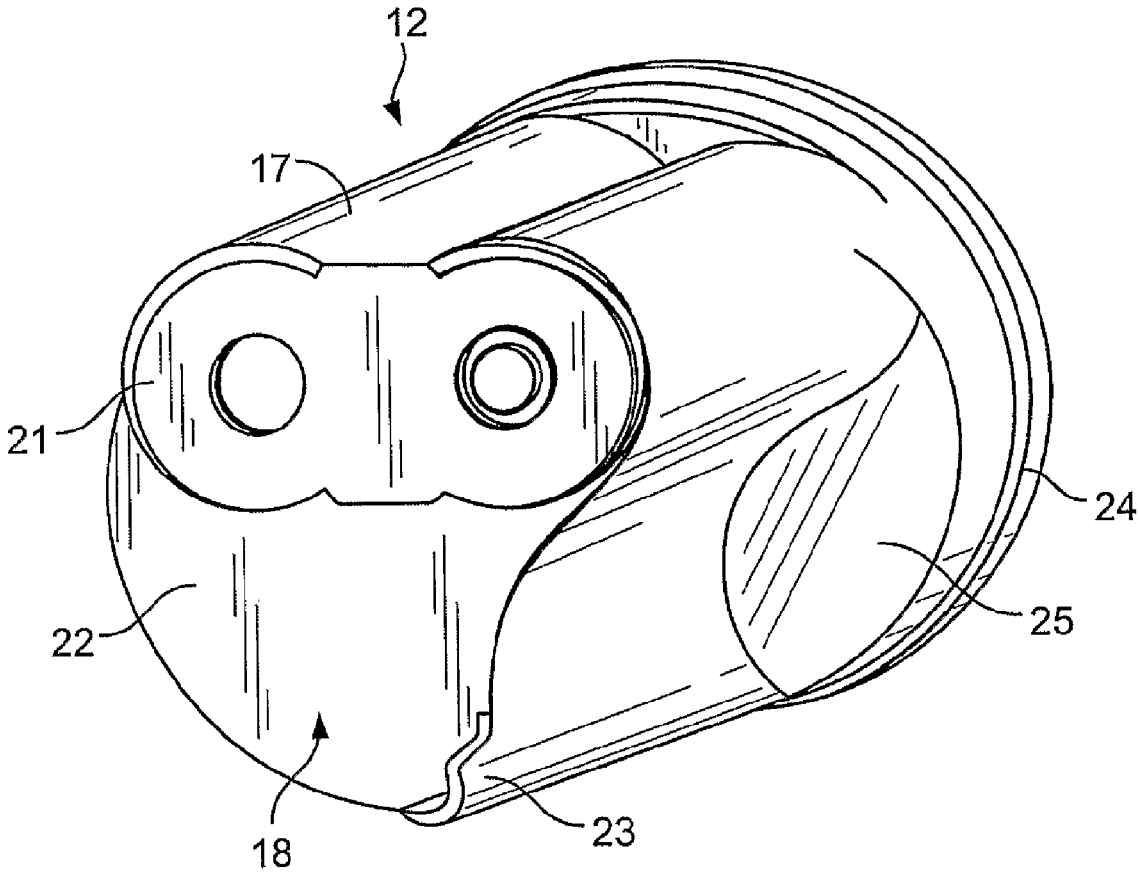
FIG. 3 shows a perspective view of a replaceable cartridge which forms part of the source of conditioning agent.

Removable unit 2 is more clearly shown in FIG. 2. It comprises a base portion 11 and a cartridge 12 which fits into the base portion. The cartridge is shown in perspective view in FIG. 3.

The base portion comprises lower region 13 in which a socket (not shown) is formed. Cartridge 12 fits into this socket in a snap-fit manner. The socket comprises a pair of electrical contacts which engage with batteries contained within cartridge 12. A motor 14 is mounted on the base portion. The motor 14 has in turn mounted on it a fan 16. The fan 16 is carried proud of motor 14 by axle 15.

Within the base unit 11 is contained a simple electronic (PCB) timing circuit (not shown), to control the motor. The user controls the motor, via the circuit, using a switch 28 on the front of the base portion, and accessible beneath the central portion 4 of the hanger. This has off, regular and boost positions, which give vapour outputs that may be described as low (or passive), medium and high.

The removable unit 12 (also shown separately in FIG. 3) is made form a moulded plastics material and comprises a battery compartment 17; a reservoir 18 comprising conditioning agent; a relatively thin cylindrical wick 19 which extends from the bottom of the reservoir, and through an aperture in its upper wall; and a disc-shaped emanator 20 carried at the distal end of the wick 19. The wick and emanator are of a capillary material, without any non-capillary through-bores. The emanator rests on the upper wall of the emanator, through which upper wall (not shown) the wick passes.

The battery compartment is designed to take two AA batteries. It is closed by a separately formed bottom wall 21. It is a factory sealed unit. The bottom wall 21 has openings to allow the required electrical contacts to be made. Removing the bottom wall breaks it in such a manner that it cannot be replaced.

The reservoir has a bottom wall 22 which is co-moulded in the one operation with the side walls of the cartridge. It can be seen in FIG. 3 that one of its side walls 23 is sigmoidal in cross-section, but that the upper end of the cartridge, at rim 24, is circular. Between the sigmoidal wall 23 and the upper rim 24 the reservoir has an undercut inclined wall 25. This can also be seen in FIG. 2. Thus the reservoir has an overhanging wall portion projecting towards the flow pathway, directly above the fan.

The top wall of the reservoir is not shown but it has a circular opening through which the wick passes. The opening helps to keep the wick in place, and in addition there is a small cup formation (not shown) in the bottom wall of the reservoir, for the wick end to stand in.

In this embodiment the emanator 20 is a circular disc of diameter 33 mm, and thickness 5 mm. In contrast the diameter of the wick is 5.2 mm. The diameter of the emanator is substantially the same as the internal diameter of the rim 24 of the cartridge.

The circular upper end of cartridge 12 is threaded on its outer edge 27. The cartridge is supplied with a screw cap lid (not shown) to prevent loss during transportation and shop display, which is removed before use. In an alternative embodiment, there is a corresponding threaded groove within the interior surface of the central portion of hanger 1, which functions as the receiving means allowing cartridge 12 to be screwed directly into hanger 1. In the embodiment shown in FIGS. 1-4, base unit 11 comprises tabs 10 which snap fit into corresponding slits in sleeve 9. Cartridge 12 fits into base unit 11 in a snap-fitted manner and is securely held in position within the sleeve.

The apparatus is designed such that when the conditioning agent is exhausted this should coincide with exhaustion of the batteries. It this does not happen precisely the chemical agent will be exhausted first, with the batteries having very little further viability. The user may purchase a replacement cartridge, with the same or different volatile conditioning agent, and already containing fresh batteries. This replacement cartridge contains a new wick and emanator.

In use, a jacket or other fabric item is mounted on the arms of the hanger and if desired a cover sheet (not shown)—preferably in the form of a suit bag—may be placed over the item(s) of clothing.

The fan is set to the desired setting by operation of the switch. If the item is simply being stored on the hanger then the user may choose to leave the switch in the off position such that passive evaporation of the conditioning agent may occur over a period of time during storage. This period of time may be several days, for example at least 7 days.

When the fan operates condition air is impelled from the source of conditioning agent through opening 4A in apex 4, along the arms 3, and out through apertures 6, 7 and 8.

If the user wishes to refresh the item prior to storage, they may wish to set the switch to the regular position and allow the fan to operate at medium output for a period of several hours, for example 4 hours.

If the item is to be worn shortly, the switch may be set to the boost position such that the fan may operate at high output for a short period of time, for example 30 minutes.

After the desired period of time, the fan is switched off, and the item is removed from the hanger. When used, a cover sheet is removed first.

In this example the conditioning agent comprises a fragrance and the item smells pleasant and refreshed following use.

The conditioning hanger has the advantage that it can be used repeatedly to freshen any number of items of clothing. When the conditioning agent and/or batteries become exhausted, cartridge 12 may be replaced.

To exchange cartridge 12, removable unit 22 is pulled out of sleeve 9 by disengagement of tabs 10 from the slits located in the lower region of the sleeve. Cartridge 12 may then be pulled away from base unit 11 and the exhausted cartridge disposed of. A new cartridge may be snap-fit into position in the socket of base unit 11, which is then re-fitted into position within the sleeve of the hanger.

The invention claimed is:

1. A conditioning hanger comprising:

two arms connected to a central region;

hanging means carried by the central region or apex, for suspending the conditioning hanger;

receiving means located at said central region or apex, being adapted to receive a source of conditioning agent, wherein the source of conditioning agent comprises engagement means, a removable reservoir containing a conditioning agent, an electrically operable fan to impel air over an emanator, and battery means to operate the fan; and at least one passageway connecting said receiving means to at least one dispensing aperture of the conditioning hanger.

2. A conditioning hanger according to claim 1 comprising two passageways, one associated with each of the arms.

3. A conditioning hanger according to claim 2 in which each arm itself defines a passageway.

4. A conditioning hanger according to claim 3 which comprises a plurality of apertures spaced along each arm.

5. A conditioning hanger according to claim 1 wherein the receiving means comprises a socket carried beneath the apex.

6. An apparatus for freshening clothes comprising a conditioning hanger according to claim 1 and a source of conditioning agent.

7. An apparatus according to claim 6 in which the conditioning agent comprises a fragrance.

8. An apparatus according to claim 6 wherein the conditioning agent is provided in the reservoir in liquid form and there is further provided a wick in communication with the conditioning agent, and the emanator is carried by the wick and located outside the reservoir.

9. A method of freshening an item of clothing, the method comprising the steps of:

(a) attaching a source of conditioning agent to the receiving means of a conditioning hanger according to claim 1;

(b) mounting the item of clothing on a conditioning hanger;

(c) leaving the item on the hanger for a period of time; and (d) removing the item from the hanger.

10. A method according to claim 9 which further comprises the of turning on the fan and of turning off the fan.

11. A kit comprising the apparatus according to claim 6 and a cover sheet.

12. A method of freshening an item of clothing using a kit as claimed in claim 11, the method comprising the steps of:

(a) attaching a source of conditioning agent to the receiving means;

(b) mounting the item of clothing on the hanger;

(c) covering the mounted item of clothing with a cover sheet;

(d) leaving the assembled kit for a period of time;

(e) removing the cover sheet from the mounted item; and (f) removing the item from the hanger.

13. An apparatus according to claim 6 wherein the conditioning agent further comprises a non-fragrancing deodorizing agent.

14. An apparatus according to claim 6 wherein the conditioning agent further comprises a sanitizer.

15. A conditioning hanger according to claim 1, wherein the conditioning agent is an sublimable solid.

16. A conditioning hanger according to claim 1, wherein the conditioning agent is an evaporable liquid.

17. A conditioning hanger according to claim 1, wherein the conditioning agent is a single chemical substance or is a mixture of chemical substances.

18. A conditioning hanger according to claim 1, wherein the conditioning agent comprises cyclodextrin.

19. A conditioning hanger according to claim 1, wherein the source of conditioning agent comprises a heater.

* * * * *